United States Patent [19]

Stessen

[11] Patent Number: 4,726,543

[45] Date of Patent: Feb. 23, 1988

[54] BRAKING ARRANGEMENT FOR A SPIN-STABILIZED PROJECTILE

[75] Inventor: Lothar Stessen, Lauf, Fed. Rep. of Germany

[73] Assignee: Diehl GmbH & Co., Nuremberg, Fed. Rep. of Germany

[21] Appl. No.: 16,548

[22] Filed: Feb. 19, 1987

[30] Foreign Application Priority Data

Mar. 12, 1986 [DE] Fed. Rep. of Germany ..... 3608109

[51] Int. Cl.[4] ..... F42B 15/02

[52] U.S. Cl. ..... 244/3.1; 102/386

[58] Field of Search ..... 244/3.1, 3.23, 3.27, 244/3.28, 3.29, 110, 113; 102/386, 387, 388

[56] References Cited

U.S. PATENT DOCUMENTS 3,047,259 7/1963 Tatnall et al. ..... 102/386

FOREIGN PATENT DOCUMENTS 3228416 2/1983 Fed. Rep. of Germany .
3335997 4/1985 Fed. Rep. of Germany .
3421140 1/1986 Fed. Rep. of Germany .

*Primary Examiner*—Charles T. Jordan
*Attorney, Agent, or Firm*—Scully, Scott, Murphy & Presser

[57] ABSTRACT

A braking arrangement for a spin-stabilized projectile, which provides for an increase in the effective surface on the projectile which is contacted by onflowing air, and which is activated in dependence upon the time of flight. There is provided a braking sail which is radially outwardly stretchable or expandable by means of centrifugal masses or flyweights.

9 Claims, 4 Drawing Figures

BRAKING ARRANGEMENT FOR A SPIN-STABILIZED PROJECTILE

BACKGROUND OF THE INVENTION

1. Field of the Invention

The present invention relates to a braking arrangement for a spin-stabilized projectile, which provides for an increase in the effective surface on the projectile which is contacted by onflowing air, and which is activated in dependence upon the time of flight.

2. Discussion of the Prior Art

A braking arrangement of the type under consideration is generally known from the disclosure of German Laid-Open patent application No. 33 35 997 for a non-spinning practice projectile, wherein the effective center of gravity is displaced to such an extent in dependence upon the flight time, whereupon the projectile will tilt out of its stable flight position into an unstable lateral or offset position after the passage of a certain time of flight, and will be rapidly braked down as a result of the resultingly increased air contacting forces.

Similar types of braking arrangements, such as those which are generally disclosed in German Laid-Open patent application Nos. 34 21 140 or 32 28 461 for ejectable final flight phase-guided ammunition, are predicated on the provision of a braking parachute or a braking balloon at the tail end of the projectile; which is released for unfolding thereof through a timing-control device for initiating its operational effectiveness. However, the function of such braking means is not obtainable with the desired operational dependability for projectiles possessing a high rate of spin. In the employment of such aerodynamic braking means it is additionally disadvantageous that, so as not to hinder the firing of a projectile from a weapon barrel or launch tube, these braking means must be located and anchored in either the tip or the base portion of the projectile. However, a braking contact against the projectile tip, as soon as the braking means becomes effective, leads to a sudden-like reversal in the orientation of the flying body or projectile with respect to the previous direction of movement, which is frequently not permissible due to apparative and aerodynamic reasons. Moreover, the spatial requirement for the target searching or acquiring and detonating sensor devices will frequently not leave any mounting space within the projectile tip for aerodynamic braking means. The extendable arranging and fastening thereof in the region of the projectile base portion is, on the other hand, frequently not possible because of constructive reasons, inasmuch as during firing of the projectile from a weapon barrel, quite considerable forces must be taken up by the base portion, in order to impart to the projectile its longitudinal and spinning movements.

SUMMARY OF THE INVENTION

In recognition of these difficulties which are encountered in the prior art, it is an object of the present invention to provide a braking arrangement of the above-mentioned type which, with regard to its arranging and its functioning is less critically integrateable in a spin-stabilized projectile.

The foregoing object is achieved with a braking arrangement pursuant to the type under consideration, in which there is provided a braking sail which is radially outwardly stretchable or expandable by means of centrifugal masses or flyweights.

In accordance with the foregoing, the engaging point or fastening of the braking arrangement to the projectile, as well as the locale of the arranging of the braking arrangement within the projectile is located in a region which is aerodynamically less critical than the tip of the projectile and constructively less critical than the tail end region of the projectile; in essence, in the central region of the cylindrical projectile casing or jacket surface. This is subjected to relatively low stresses during a firing of the projectile, as a result of which it is quite common to machine out of the central region of the projectile for effecting a reduction in the weight and determining the center of gravity, through the replacement use of lighter materials, such as molded plastic materials, so as to again bring the projectile to its aerodynamically desired external contour.

Consequently, the inventive object is predicated on the recognition that, through the intermediary of a radially extendable braking sail which is dependent upon centrifugal force, there can be produced braking effects which possess at least the magnitude of those constructively attainable braking parachutes or braking balloons; whereby, through the geometric correlation of the surface and surface distribution of the braking sail about the periphery of the projectile, and by means of the braking sail points of engagement relative to the center of gravity of the projectile, there is constructively predeterminable within broad bounds the behavior in flight of the projectile beginning with the effect of the braking forces. Particularly through the quantity and size of the flyweights at the outer edge of the extended braking sail, and the radial extension thereof outside of the casing surface of the projectile, there is constructively predeterminable within wide bounds, the rapidity at which there occurs the reduction in the longitudinal movement and in the spin; with the result, that after a sufficient reduction in the spin, the axially-parallel onflow of air will lead to a positioning of the no longer radially tensioned braking sail against the rearward region of the projectile casing surface, and the projectile will again assume almost approaching aerodynamic flight characteristics, even with also only considerably reduced components of motion and, at times, with a changed orientation relative to the previous flight position.

BRIEF DESCRIPTION OF THE DRAWINGS

Additional alternatives and embodiments, as well as further features and advantages of the invention, can now be readily ascertained from the following detailed description of an illustrative embodiment of the invention, taken in conjunction with the accompanying drawings; in which.

DETAILED DESCRIPTION

Figure 1:
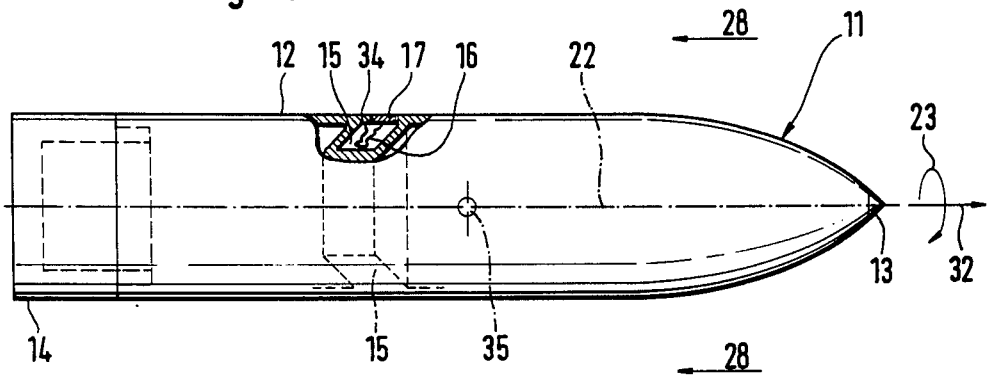
FIG. 1 illustrates in a longitudinal side view, partly in section, a projectile flying in a spin-stabilized mode.
Figure 4:
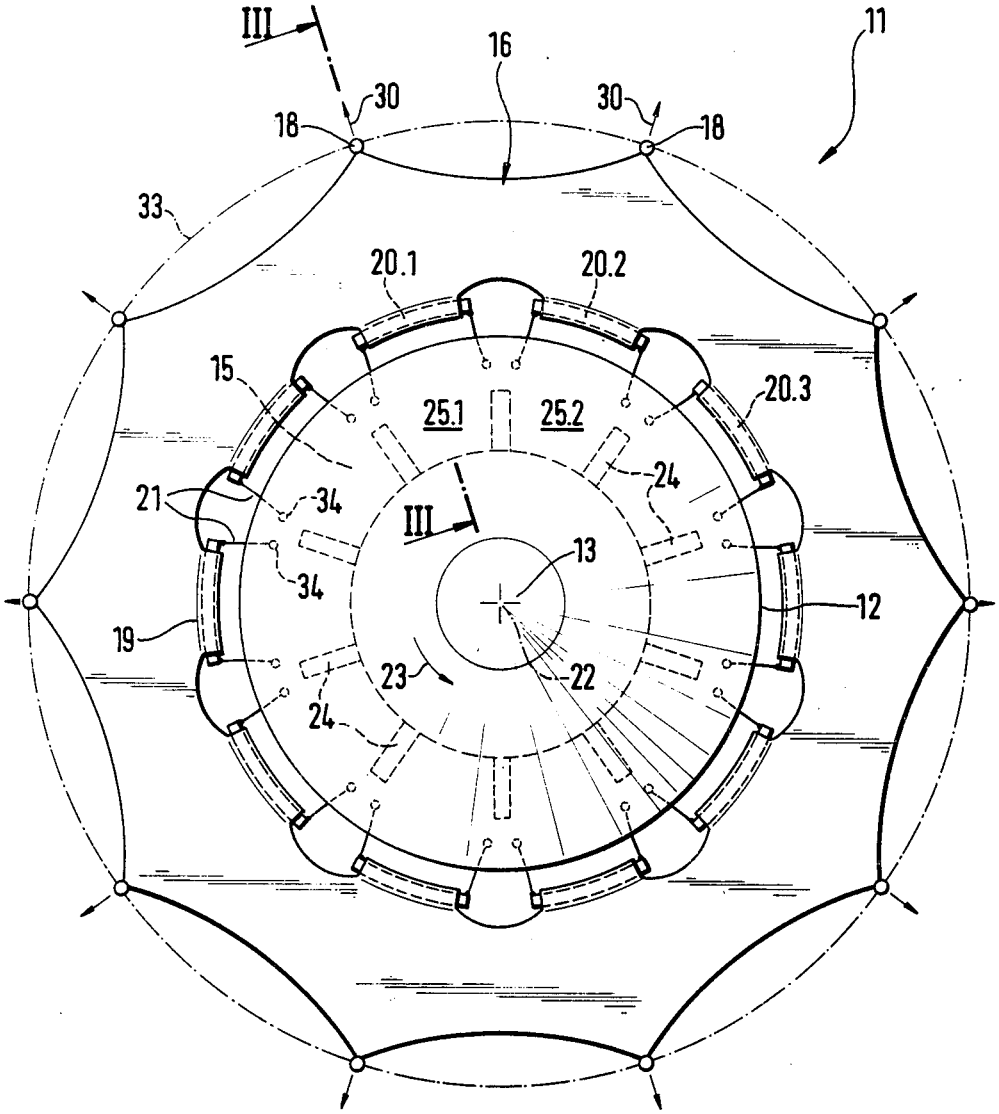
FIG. 4 illustrates an end view of the projectile pursuant to FIG. 3.

The spin-stabilized projectile 11, which is illustrated in FIG. 1, provides in a region of its casing 12, which is located between the tip 13 and the base portion 14, at least one circumferentially extending recess 15 for the receipt of an initially still folded-in braking sail 16. Along the contour of the casing 12, the recess 15 is closed off by means of curved cover segments 17. The folded-in cloth or fabric of the braking sail 16 is fastened, at one side, to the structure of the projectile 11; in essence, indirectly fastened to its casing 12, and on another side, is equipped with at least two, and preferably at least three peripherally mutually offset centrifugal masses or flyweights 18, and, for example, may be constituted of small metal balls or spheres. The fastening region 19 of the braking sail 16 encircles a ring-shaped restraining rod 20, which in the illustrated exemplary embodiment, is carried by a flexible retainer 21. In the direction extending in parallel with the longitudinal axis of flight 22; in effect, in parallel with the hollow-cylindrical projectile casing 12, the ring-shaped restraining rod 20 is mechanically fastened against undesirable displacement during the course of the firing acceleration of the projectile 11 by its fit into the small recess 15. For peripheral positioning, in effect, against rotational displacement caused by the spin 23 of the projectile 11 the ring-shaped restraining ring 20 is preferably divided into a plurality of individual arcuate sections (20.1, 20.2, and so forth, as shown in FIG. 4), which are each supported at their end surfaces against any peripheral displacement by contacting against radially extending separating walls 20, through means of the latter of which the radially inwardly located portion of the recess 15 is divided into mutually peripherally offset chambers 25.1, 25,2, and so forth.

Figure 2:
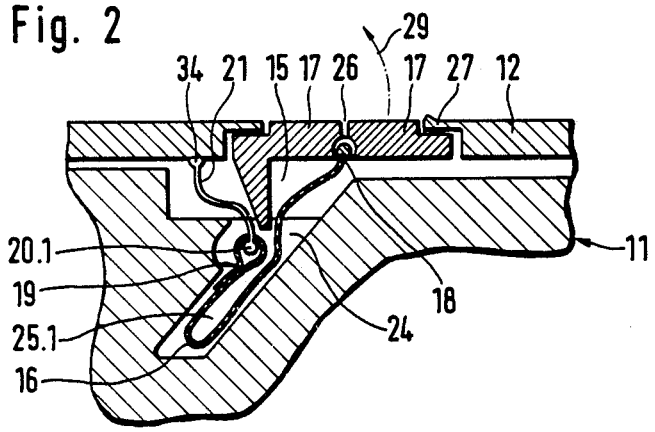
FIG. 2 illustrates, on an enlarged scale, a fragmentary representation of the cross-sectioned portion of FIG. 1.

In conformance therewith, the centrifugal masses or weights 18, and if necessary also the curved sections of the restraining rods 20, are formfittingly fixed against peripheral and axial displacement in the region of the casing 12 of the projectile, preferably near the separating regions 26 of the cover segments 17, as can be clearly ascertained from FIG. 2.

After the passage of a certain time of flight for the projectile 11, the latching of the cover section 17 is released. This can be implemented through the utilization of an electrical or pyrotechnic timing circuit (not shown), which draws a latching pin by means of an electromagnetic or a pyrotechnic power element; however, this can also be carried out through the burning off of a retaining strap 27 on the projectile casing 12, which is heated up due to the action of the oncoming airflow 28 at a kinematically defined point in time, and so changes its previous mechanical stability and/or geometric shape.

Figure 3:
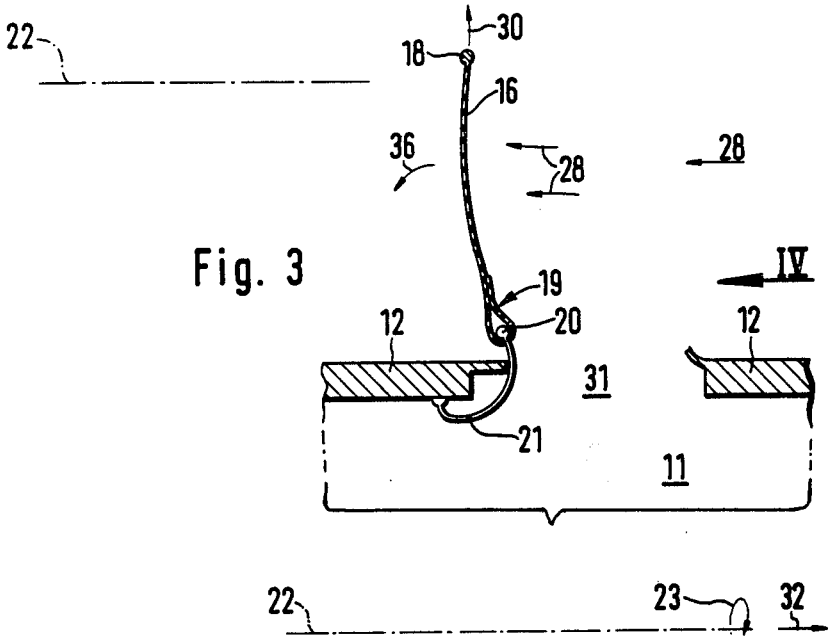
FIG. 3 illustrates a segment of FIG. 2 with an extended braking sail.

In any event, during the flight of projectile 11 there is reached the point in time at which the cover 17 is released from its original constructive latching, and is accelerated or thrown out in a radial direction 29 as a consequence of the centrifugal forces produced by the spin 23. Thereby, the centrifugal masses or flyweights 18 are released and are similarly accelerated in a radially outward direction 29, as a result of which they radially pull out the folded-together fabric of the braking sail 16 which is folded into the recess 15 or, in essence, the chambers 25 thereof, from the contour of the casing 12 of the projectile, and under the influence of the centrifugal forces 30 (as shown in FIG. 3) transversely of the projectile axis 22, thereby tensioning the sail radially. In order to prevent any damage from taking place along the ring-shaped opening 31 in the projectile casing 12, in the illustrated exemplary embodiment of the drawings it is contemplated that the flexible restrainers 21 for the segmented ring-shaped restraining rods 20 allow for a radial displacement of the restraining rods 20 out of the opening 31 into a region which is radially outside of the casing 12, wherein the centrifugal force 30 is assumed by the fastening region 19 of the braking sail. The onflow of the surrounding air 28 which is caught in the radially outwardly extended braking sail 16, leads to a slightly convex curvature relative thereto in the direction opposite that of the direction of flight 32 of the projectile; however, due to the at least initially extremely rapid spin 23 of the projectile 11, the force components of the centrifugal force 30 are preponderant and the braking sail is essentially peripherally deployed in the shape of a broad radial ring about the casing 12 of the projectile, as is illustrated in FIGS. 3 and 4.

This deployed braking sail 16 extends the more uniformly about the projectile 11, the more discrete or individual centrifugal masses or weights 18 there are provided. Preferably, the fabric of the braking sail 16 is cut so that the radially outwardly accelerated centrifugal masses 18 will, with an outwardly tensioned braking sail 16, be arranged along a circle 33 which is concentric relative to the projectile axis 22, such that an axially-symmetrical braking force-producing contact will be produced by the air onflow 28 acting on the projectile 11. A further influence over the flight characteristic of the projectile 11 which is braked by the deployed braking sail 16 is constructively possible through a predetermination of the location of the engaging points 34 of the braking sail retainers 21 in relation to the location of the dynamic center of gravity 35 of the projectile 11 (referring to FIG. 1). Thus, this then leads to a tipping of the projectile 11 from the stable flight thereof into an unstable condition, when the engaging points 34 for the braking sail are located ahead of the center of gravity 35.

The tensioning of the braking sail 16 which results from the centrifugal forces 30 leads to an extremely considerable reduction in the previous speed along the direction of flight 32, with a pitching down or downward tipping of the projectile 11 (in accordance with the conditions of the center of gravity) from the momentary position of flight. The increase in the moment of inertia on the basis of the radially extended centrifugal masses or flyweights 18 which are anchored to the fabric of the braking sail 16, superimposes a rapid reduction in the spin 23, upon which this translatory braking effect leads to a corresponding reduction in the centrifugal forces 30; in effect, in the radial tensile forces which act on the fabric of the braking sail 16.

Even already at the passage of a relatively short period of time can the centrifugal forces 30 become so low as a result thereof, that notwithstanding the braked-down longitudinal movement, the forces of the air onflow 28 which contact against the sail 16 opposite the longitudinal direction of movement 32, lead to a positioning of the sail 16 in the direction 36 (FIG. 3) against the base portion 14 of the projectile 11.

Thereby, the forces which heretofore reduced the spin 23 and the speed in the longitudinal direction 32, have become practically ineffective, and the projectile 11 travels further at a reduced rotational and longitudinal speed, as well as eventually along a changed trajectory. Upon suitable equipping with detonator sensors and/or aerodynamic control or guidance devices (not shown), the projectile 11 can now be employed as search head-detonator ammunition, or in essence, as a final flight phase - maneuverable target-seeking ammunition, inasmuch as the longitudinal and rotational speeds have been reduced to a corresponding operationally-correlated extent. In the utilization of the projectile 11 as practice ammunition, the braking sail engaging points 34 can be so selected in relation to the center of gravity 35 of the projectile, that the projectile will be braked down to such an extent immediately after the ejection of the recess cover 17, while being transferred into an unstable flight position, so as to steeply descend towards the ground; in effect, for example, after the previous purely ballistic trajectory, to be reliably caught within the practice safety area.

What is claimed is:

1. In a braking arrangement for a spin-stabilized projectile, for the provision of an increase in the effective surface on a projectile contacted by an oncoming air flow which is initiated in dependence upon the time of flight; the improvement comprising: a braking sail on said projectile; and centrifugal weights for radially deploying said braking sail.

2. A braking arrangement as claimed in claim 1, wherein said braking sail is constituted of a fabric which is stowed in recesses extending about the circumference of the casing of the projectile.

3. A braking arrangement as claimed in claim 2, wherein the braking sail is fastened opposite said centrifugal weights to curvilinear restraining rods which are fastened in the region of the recesses in said casing.

4. A braking arrangement as claimed in claim 2, wherein radially removable cover means are located in the projectile casing extending over said recesses and the fabric of the folded braking sail within said recesses.

5. A braking arrangement as claimed in claim 1, wherein the centrifugal weights which are fastened to the braking sail are releasably positioned in the region of the projectile casing in axially, circumferential and radial directions relative to the longitudinal axis of the projectile.

6. A braking arrangement as claimed in claim 3, wherein said restraining rods are in the shape of ring segments which are peripherally latchable in said recesses intermediate chamber-forming chamber separating walls.

7. A braking arrangement as claimed in claim 3, wherein said restraining rods are fastened by flexible retrainers to the projectile casing.

8. A braking arrangement as claimed in claim 6, wherein said restraining rods are axially and peripherally latchable in said recess chambers, and axially latchable by said cover means.

9. A braking arrangement as claimed in claim 1, wherein the engaging points of the braking sail with said projectile are located in the direction of flight rearwardly of the dynamic center of gravity of the projectile.

* * * * *